US007047962B2

(12) United States Patent
Henry et al.

(10) Patent No.: US 7,047,962 B2
(45) Date of Patent: May 23, 2006

(54) AIR CONTROL FOR A CLEAN BURNING FIREPLACE

(75) Inventors: Daniel S. Henry, Kettle Falls, WA (US); Colin McCormick, Kettle Falls, WA (US); Matt Owings, Colville, WA (US); Brian L. Wallace, Colville, WA (US)

(73) Assignee: HNI Technologies Inc., Muscatine, IA (US)

( * ) Notice: Subject to any disclaimer, the term of this patent is extended or adjusted under 35 U.S.C. 154(b) by 129 days.

(21) Appl. No.: 10/777,791

(22) Filed: Feb. 12, 2004

(65) Prior Publication Data

US 2004/0244791 A1 Dec. 9, 2004

Related U.S. Application Data

(60) Provisional application No. 60/453,047, filed on Mar. 6, 2003.

(51) Int. Cl.
*F24C 1/14* (2006.01)

(52) U.S. Cl. ..... 126/77; 126/112

(58) Field of Classification Search ..... 126/77, 126/112 X, 15

See application file for complete search history.

(56) References Cited

U.S. PATENT DOCUMENTS

| | | | | |
|---|---|---|---|---|
| 4,141,336 | A | 2/1979 | Fitch | |
| 4,306,538 | A * | 12/1981 | Frieber | 126/290 |
| 4,465,055 | A * | 8/1984 | Bortz | 126/502 |
| 4,691,686 | A * | 9/1987 | Alvarez | 126/77 |
| 4,766,876 | A | 8/1988 | Henry et al. | |
| 4,832,000 | A | 5/1989 | Lamppa et al. | |
| 5,113,843 | A | 5/1992 | Henry et al. | |
| 5,218,953 | A | 6/1993 | Shimek et al. | |
| 5,263,471 | A | 11/1993 | Shimek et al. | |
| 5,341,794 | A | 8/1994 | Henry et al. | |
| 5,553,604 | A | 9/1996 | Frei | |
| 6,041,771 | A | 3/2000 | Hayes | |
| 6,227,194 | B1 | 5/2001 | Barudi et al. | |
| 6,705,310 | B1 | 3/2004 | Buzzard et al. | |

FOREIGN PATENT DOCUMENTS

| | | |
|---|---|---|
| AT | 389 381 B | 11/1989 |
| EP | 0 480 870 A1 | 4/1992 |
| GB | 1 510 706 | 5/1978 |

* cited by examiner

*Primary Examiner*—Alfred Basichas
(74) *Attorney, Agent, or Firm*—Faegre & Benson LLP

(57) ABSTRACT

An automatic air intake control includes a timing mechanism that regulates the amount of air entering a combustion chamber enclosure during combustion of a fuel. The amount of air is regulated to provide an efficient and clean burn of a solid fuel. The control may include a cover, an actuating assembly, and a controller. The cover is movable between open and closed positions relative to an air passage opening into the combustion chamber enclosure. The actuating assembly is coupled to the cover and configured to move the cover between the open and closed positions. The controller is coupled to the actuating member and configured to control the position of the cover through the actuating member to regulate the air intake into the combustion chamber. The controller may be a time-based device such as a timer, or may be any other device that uses inputs associated with the combustion of fuel in the combustion chamber or a user's preferences for the characteristics of combustion in combustion chamber.

30 Claims, 8 Drawing Sheets

AIR CONTROL FOR A CLEAN BURNING FIREPLACE

CROSS REFERENCE TO RELATED APPLICATIONS

This application claims priority to U.S. Provisional Application Ser. No. 60/453,047, filed on Mar. 6, 2003, entitled AIR CONTROL FOR A CLEAN BURNING FIREPLACE, which application is incorporated by reference herein in its entirety.

FIELD OF THE INVENTION

The present invention relates to solid fuel burning units, such as wood stoves, fireplaces, and inserts. More particularly, the invention relates to an apparatus for providing clean burning stoves, fireplaces, and inserts.

BACKGROUND OF THE INVENTION

The Clean Air Act mandates pollution standards for wood burning fireplaces and stoves. The Environmental Protection Agency (EPA) has set stringent standards with regard to the grams of particulate emissions per hour for non-catalytic stoves. These particulate emissions are substances that are discharged into the air due to the incomplete combustion of fuel. The EPA standards require that a fireplace or stove burn cleanly at all settings or burn rates. Burn rates are measured as the speed in which fuel is consumed by fire. In order to be EPA certified a fireplace must be tested at four different burn rates: low, medium-low, medium-high, and high. The procedures for testing the burn rate of a fireplace or stove typically vary with the size of its combustion chamber.

In addition to these stringent standards, state and local codes have become, even tighter and more rigorous standards than the federal law. For example, the State of Washington has more stringent regulations than is required by the EPA. Further, many cities and local communities have promulgated standards that cannot be met by all existing wood burning fireplaces and most wood burning stoves. New fireplaces or stoves that are not certified to meet these requirements cannot be sold in the United States.

The purpose for these federal, state, and local requirements is to create a clean burning fireplace, which releases a low amount of materials into the atmosphere during combustion. Two methods for providing a clean burning fireplace are shown and described in our U.S. Pat. Nos. 4,766,876 and 5,263,471, incorporated herein by reference. In these patents, fireplaces are described that allow for secondary combustion in the top of the combustion chamber. This secondary combustion provides a more efficient and cleaner burning fireplace. However, there are some limitations to the current fireplace's ability to reduce emissions.

First, it can be difficult to meet the EPA's and other governmental requirements for each of the burn rates even when utilizing secondary combustion as described in U.S. Pat. Nos. 4,766,876 and 5,263,471, which are incorporated herein by reference. This is particularly true for testing larger volume wood burning units tested at a low burn because it is often difficult to create enough heat to ensure sufficient secondary combustion. Typically, the volume of wood burning units is limited to about 3 cubic feet. Second, these fireplaces do not provide stepwise control of the amount of combustion air entering the wood burning during a burn to correspond to a change in a solid fuel. For example, the amount of air needed for combustion may vary for fuels that are changing from an organic state to a charcoal state. Third, these fireplaces may not provide the proper amount of primary air for primary combustion and secondary air for secondary combustion to meet governmental testing standards.

Accordingly, it is desirable to provide a fireplace assembly with an improved ability to meet governmental emission requirements under designated burning conditions.

SUMMARY OF THE INVENTION

Generally, the present invention relates to a solid fuel-burning unit, such as a wood fireplace, stove, or insert. More particularly, the invention relates to an apparatus for reducing emissions and providing cleaner burning solid fuel in wood burning devices by controlling the flow of combustion air. The flow of combustion air may be controlled based on many different methods, including, for example, time-based control, temperature-based control, emissions-based control, light-based control, pressure control (positive and/or negative), static, or any other method that uses inputs associated with the combustion of fuel in the fuel-burning unit or a user's preferences for the characteristics of combustion in the fuel-burning unit.

One aspect of the invention relates to an apparatus for burning solid fuel that includes a combustion chamber enclosure that defines a combustion chamber for combustion of a fuel and including an air passage opening, and an automatic air intake control configured to regulate air intake into the combustion chamber through the air passage opening for combustion of the fuel. The automatic air intake control may include a cover, an actuating assembly, and a timer. The cover is movable between open and closed positions, and may provide a substantially air-tight seal with the air passage opening when the cover is in the closed position. The actuating assembly is coupled to the cover and configured to move the cover between the open and closed positions. The timer is coupled to the actuating member and configured to control the position of the cover through the actuating member to regulate the air intake into the combustion chamber. In some embodiments, an actuating assembly may not be necessary if, for example, the timer is coupled directly to the cover, or if the cover includes a self actuating device that is controlled by, for example, an electronic timer.

Another aspect of the invention relates to a method for automatic control of combustion within an apparatus that burns solid fuel. The apparatus includes a combustion chamber enclosure that defines a combustion chamber for combustion of fuel, an air passage opening formed in the combustion chamber enclosure, and an automatic air intake control that includes a cover, a timer and an actuating assembly. The method may include adjusting the cover from a closed position covering the air passage to an open position removed from the air passage so as to provide air flow into the combustion chamber, actuating the cover between the open and closed positions with the actuating assembly, and controlling a position of the cover over a period of time with the timer thereby controlling intake of air through the air passage into the combustion chamber.

A yet further aspect of the invention relates to an automatic air intake control for regulating air intake into an apparatus that is configured to burn solid fuel. The automatic air intake control may include a cover that is movable between open and closed positions relative to an air passage opening into the combustion chamber, and further includes a timer coupled to the cover that is configured to control the position of the cover to regulate the intake of air into the combustion chamber. The air intake control may also include an actuating member coupled to the cover that is actuated by the timer.

The above summary of the present invention is not intended to describe each disclosed embodiment or every implementation of the present invention. In particular, the example embodiments described below in relation to the Figures use time-based control of combustion in a fireplace, whereas many other methods of control may be used to fulfill the purposes and intents of the present invention. Figures in the detailed description that follow more particularly exemplify certain embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 2:
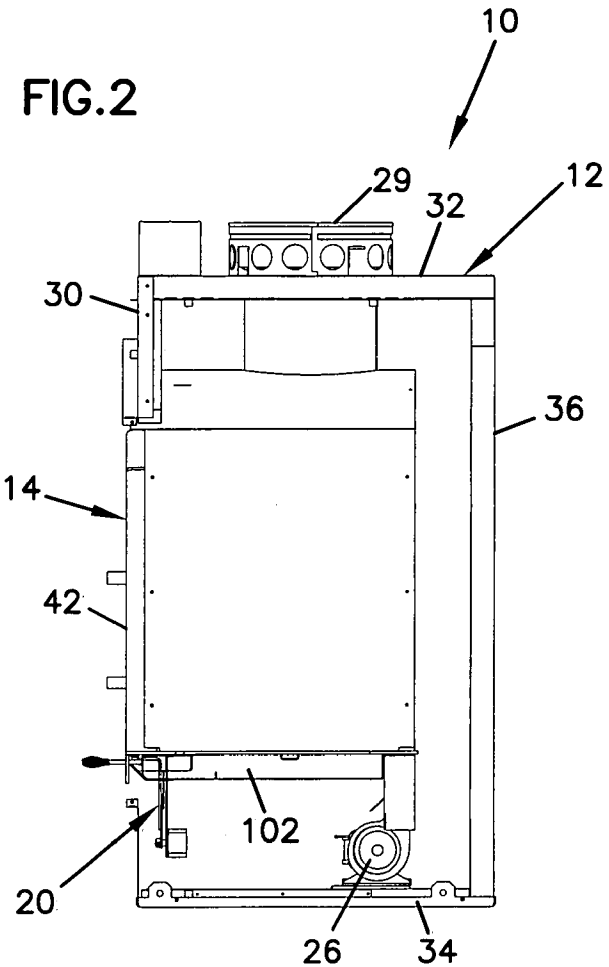
FIG. 2 is a side view of the fireplace shown in FIG. 1 with a side panel removed to show a side view of the automatic air intake control unit.
Figure 1:
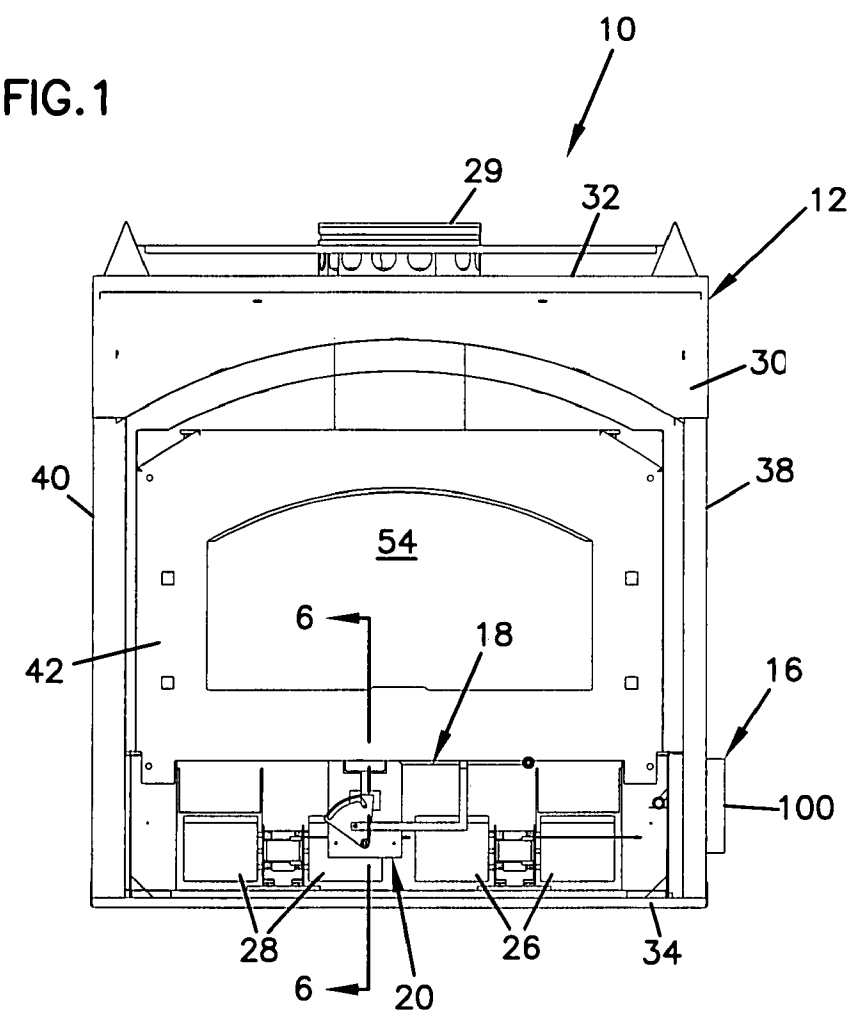
FIG. 1 is a front view of an example fireplace including one embodiment of an automatic air intake control unit in accordance with principles of the present invention.
Figure 3:
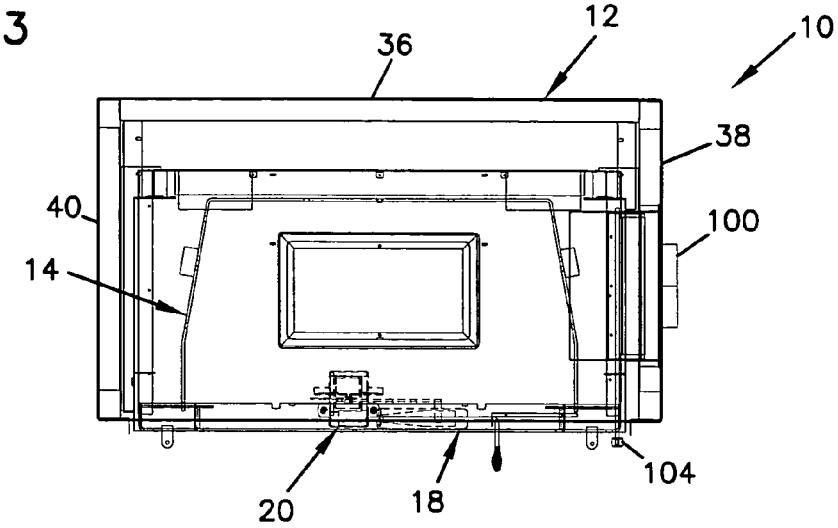
FIG. 3 is a top view of the fireplace shown in FIG. 1 with a top panel removed to show a top view of the automatic air intake control unit.
Figure 4:
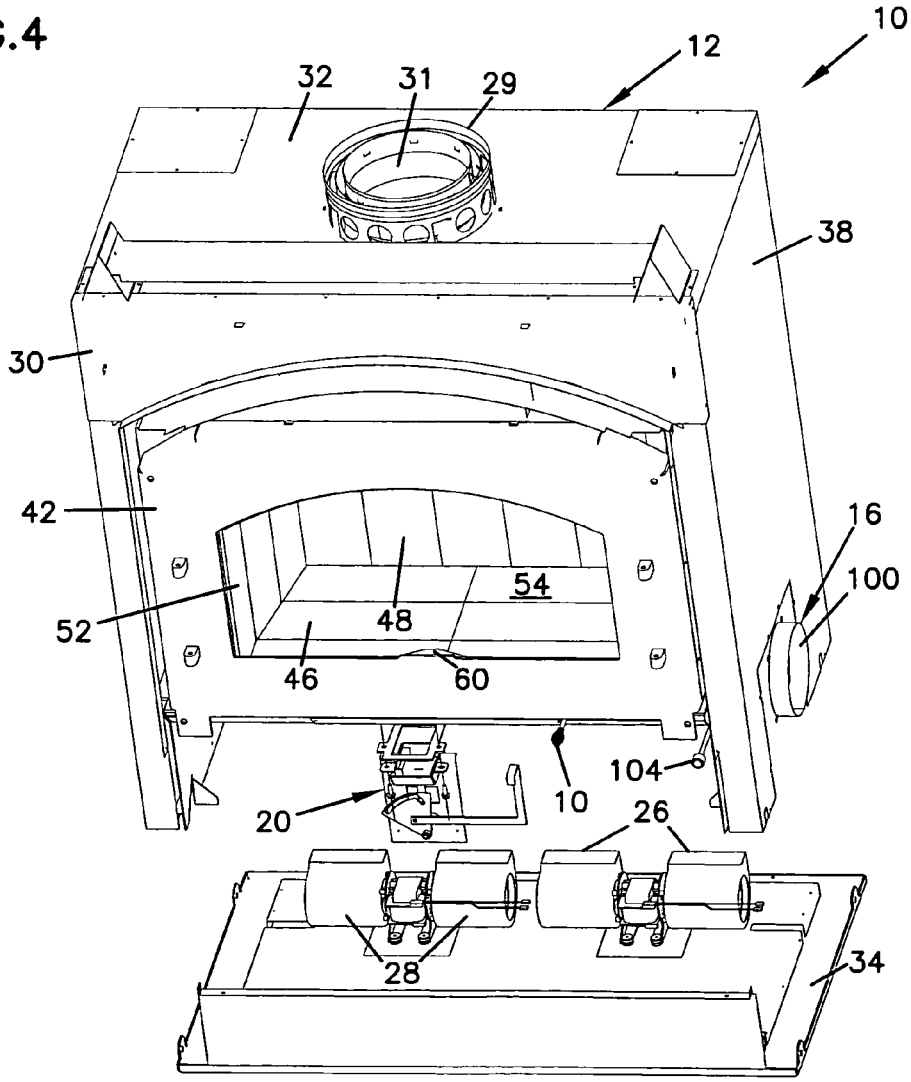
FIG. 4 is an exploded front perspective view of the fireplace shown in FIG. 1.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

The invention is applicable to any system that burns solid fuel. In particular, the invention is directed to an apparatus for providing low emissions and cleaner burning wood fireplaces, stoves, and inserts. While the present invention is not so limited, an appreciation of the various aspects of the invention will be gained through a discussion of the examples provided below.

Embodiments of the present invention may be used with any system or apparatus that ignites a solid fuel to produce heat. While the example embodiments of the present invention provided below are described in conjunction with an example wood burning fireplace, the present invention is equally applicable to other systems or apparatuses that burn solid fuel.

As used herein, the term "coupled" means any structure or method that may be used to provide connectivity between two or more elements, which may or may not include a direct physical connection between the elements. The phrase "combustion chamber enclosure" may include any enclosure in which flames and/or heat are generated. The term "cover" is defined as any suitable structure that restricts the flow of fluid through a fluid passage. The term "timer" is defined as any controlling device, and preferably a controlling device that is capable of controlling in a time sensitive manner. Example timers that may be useful include digital, analog and manual timers that are capable of performing certain functions within a predetermined time period (e.g., rotation of a shaft or linear actuation of a shaft at a predetermined rate). The timer shown and described herein is an example time-based device for time-based control of combustion in the combustion chamber enclosure. Other embodiments of the present invention may use other methods of controlling combustion, such as, for example, temperature-based control, emissions-based control, light-based control, pressure control (positive and/or negative), static, or any other method that uses inputs associated with the combustion of fuel in the fuel-burning unit or a user's preferences for the characteristics of combustion in the fuel-burning unit.

An example fireplace assembly 10 that includes features of the present invention is shown in FIGS. 1–4. Fireplace 10 includes an outer enclosure 12, a combustion chamber enclosure 14, a fresh air inlet assembly 16, a main air control 18, and an automatic air intake control 20. Fireplace 10 also includes an air wash system 22 (see FIGS. 14 and 16), a manifold system 24 (see FIGS. 15 and 16), two blowers 26, 28, and outer and inner exhaust vents 29, 31.

The outer enclosure 12 includes a front panel 30, a top panel 32, a bottom panel 34, a back panel 36, and side panels 38, 40, which panels together define an enclosure in which the combustion chamber enclosure 14 is mounted. Combustion chamber enclosure 14 is shown separate from the outer enclosure 12 in FIGS. 14–16 and includes a front panel 42, a top panel 44, a bottom panel 46, a back panel 48, a first side panel 50, and a second side panel (not shown). The combustion enclosure panels together define a combustion chamber 54 having a lower portion 56, and an upper portion 58 (see FIG. 16). A primary combustion air opening 60 (see FIGS. 4 and 16) provides for air flow of primary combustion air into the combustion chamber 54.

The manifold system 24 is positioned within combustion chamber enclosure 14 and is configured to promote secondary burn of combustible materials in combustion chamber 54. Manifold system 24 includes first and second vertical air channels 70, 72, first and second manifold chambers 74, 76, and first, second and third manifold distribution tubes 78, 80, 82 (see FIGS. 15 and 16). The use of manifold system 24 for secondary combustion of fuel within combustion chamber 54 is described in further detail below.

Figure 14:
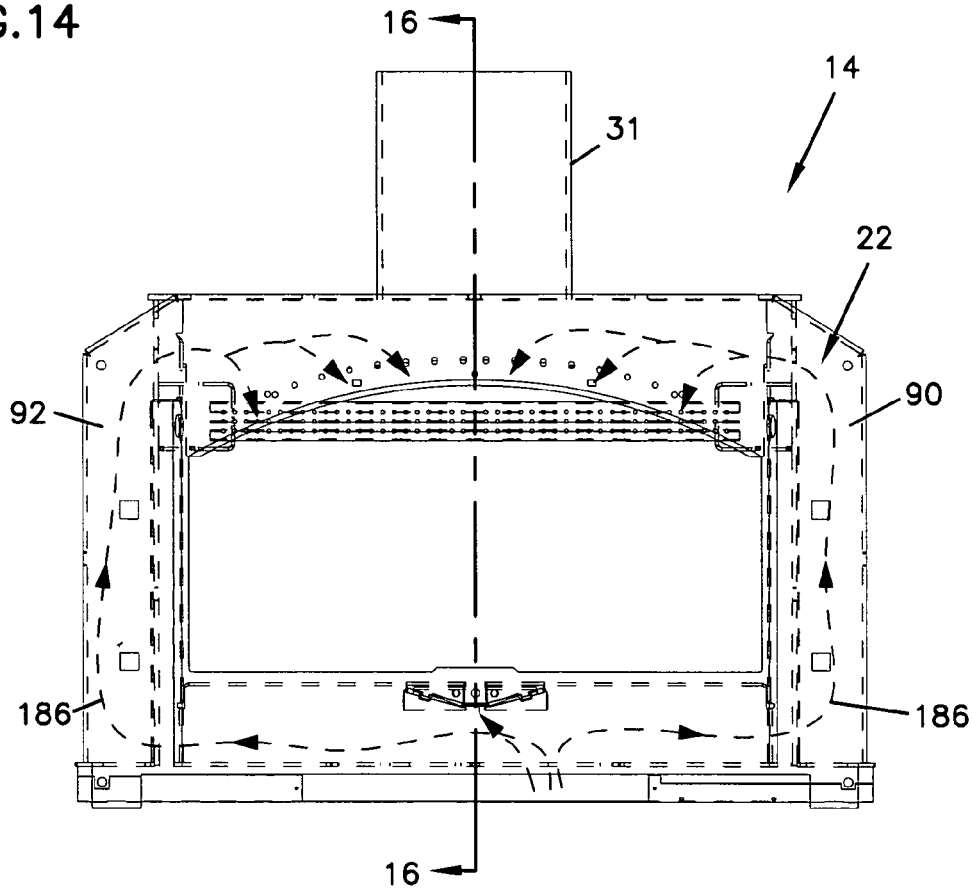
FIG. 14 is a front view of the combustion chamber enclosure portion of the fireplace shown in FIG. 1 with flow lines indicating airflow for an air wash system according to principles of the present invention.
Figure 15:
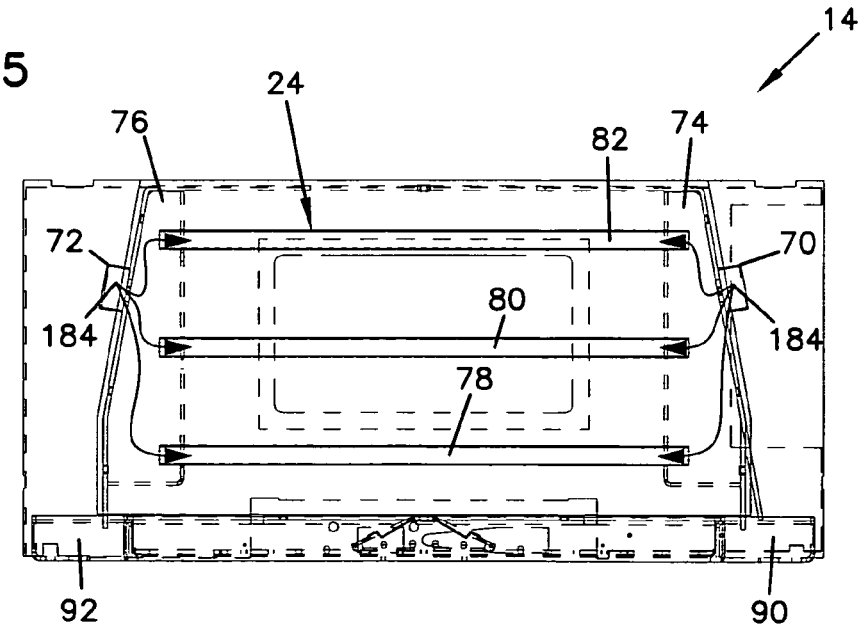
FIG. 15 is a top view of the combustion chamber enclosure shown in FIG. 14 with flow lines indicating airflow to a manifold of the fireplace for secondary combustion within the combustion chamber.
Figure 16:
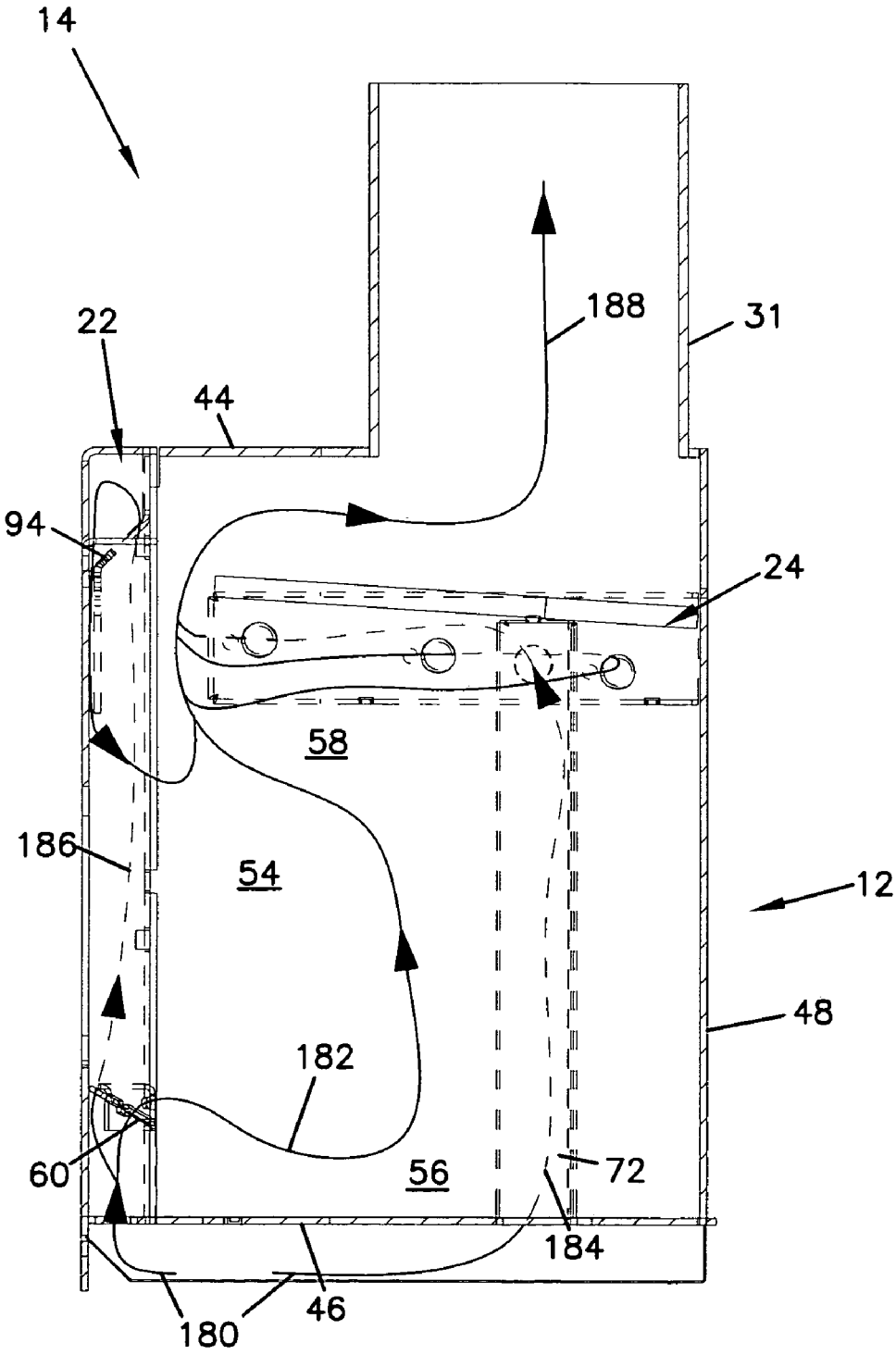
FIG. 16 is a cross-sectional view of the combustion chamber enclosure shown in FIG. 14 taken along cross-sectional indicators 16—16, and includes flow lines indicating airflow for primary and secondary combustion and an air wash system of the fireplace.

Referring now to FIGS. 14 and 16, the air wash system 22 includes first and second vertical channels 90, 92 positioned near front panel 42 of the combustion chamber enclosure 14, and an air wash plate 94 having a slot formed therein (not shown) and that is positioned along a top of the viewing opening into combustion chamber 54. Air wash system 22 is configured to direct fresh air along the front of combustion chamber 54, particularly across the doors or glass viewing panels of the fireplace when doors are mounted (not shown) to front panel 42 and oriented in a closed position.

The fresh air inlet assembly 16 includes a fresh air vent 100, a fresh air channel 102, and a fresh air control arm 104 (see FIGS. 1–4). The fresh air vent 100 may be positioned at any location around the outer enclosure 12 to provide a source of fresh combustion air into the fresh air channel 102, which is in fluid communication with the main air control 18 and the automatic air intake control 20. The fresh air control arm 104 may be used to control air flow entering from the fresh air vent 100. In other embodiments, a source of fresh combustion air may be provided through a direct venting system that is coaxial with the exhaust vents 29, 31.

Figure 5:
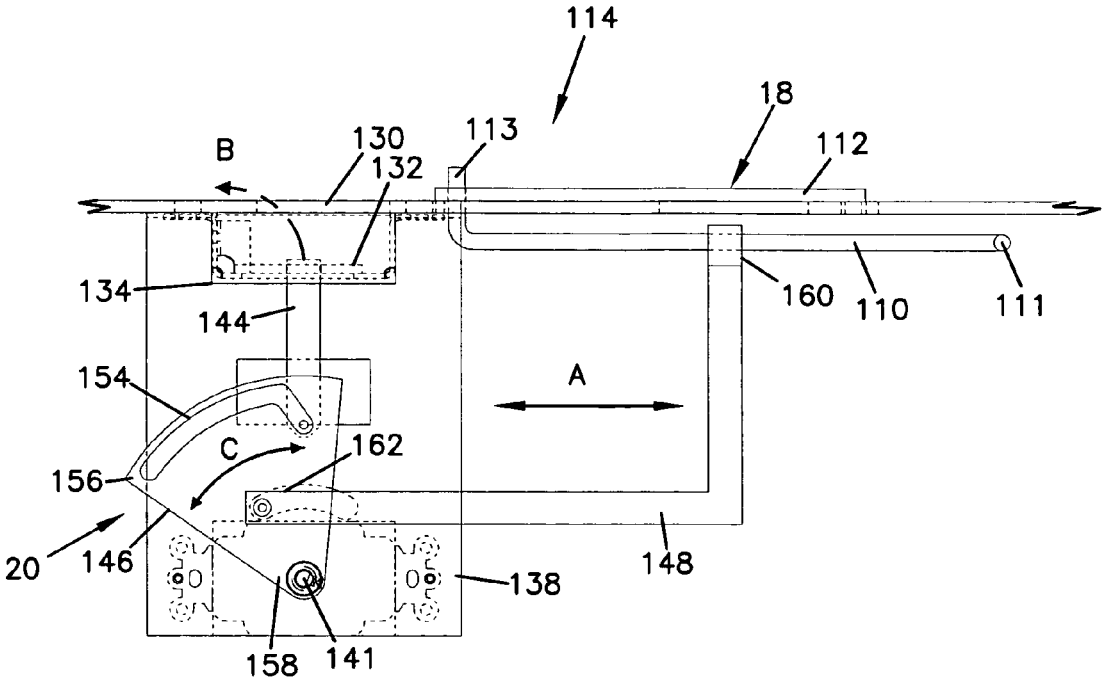
FIG. 5 is a close-up front view of the automatic air intake control unit configuration shown in FIG. 1 with a front panel of the fireplace removed, the automatic air intake cover closed, and the main air intake opening closed.
Figure 6:
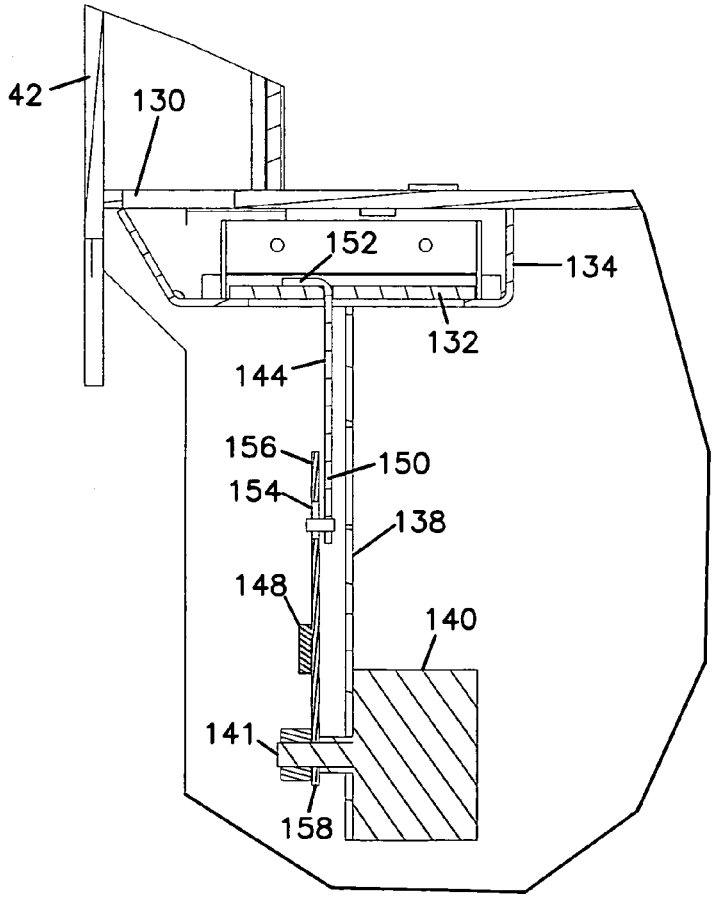
FIG. 6 is a cross-sectional view of the automatic air intake control unit shown in FIG. 1 taken along cross-sectional indicators 6—6.
Figure 7:
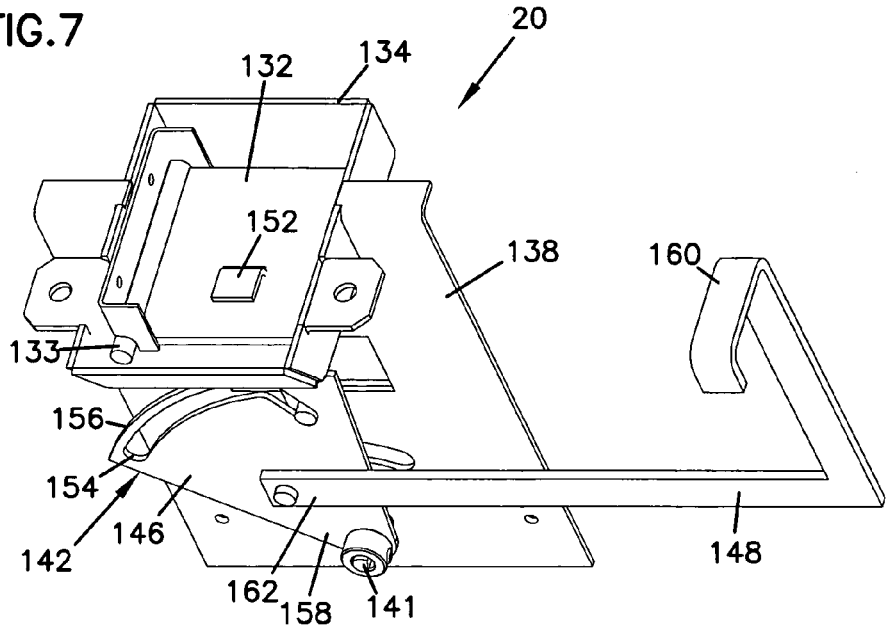
FIG. 7 is a top perspective view of the automatic air intake control unit shown in FIG. 1.

The main air control 18 includes a control arm 110, a cover 112, and a main air opening 120. Control arm 110 includes a control handle at a first end 111 and is secured to the cover 112 at a second end 113. Control arm 110 adjusts a position of cover 112 in the direction A between first and second positions 114, 118 in which the main air opening 120 is respectively closed (see FIGS. 5 and 12) and completely open (see FIGS. 9 and 10).

When main air opening 120 is completely closed, flow of combustion air into combustion chamber 54 is limited to air flow through the automatic air intake control 20. Cover 112 may be moved by control arm 110 to vary the opened size of main air opening 120 thereby controlling the rate of combustion of the combustible fuel in combustion chamber 54. One drawback of such main air controls is that setting the cover 112 at one predetermined position to define a certain opening size for main air opening 120 is effective for only a single rate of combustion, while there may be several different rates of combustion that are most effective as the amount of fuel changes and the heating requirements for the fireplace 10 change over time. Because of the manual nature of main air control 18, the cover 112 must be repositioned to meet each combustion position desired.

Automatic air intake control 20 addresses the need for variable rates of airflow into the combustion chamber 54 for varying combustion conditions. Automatic air intake control 20 is positioned adjacent to an automatic air intake opening 130 that is in fluid communication with the air wash system 22, the air inlet 60, and the combustion chamber 54. In some embodiments, the automatic air intake control 20 may also be in fluid communication with the manifold system 24 as well. Automatic air intake control 20 includes an adjustable cover 132 that can be positioned relative to an opening into fresh air channel 102 to determine the amount of air flow possible between fresh air channel 102 and automatic air intake opening 130. When the main air opening 120 is closed, the cover 132 completely controls air flow of primary combustion air into the combustion chamber 54, and when the main air opening 120 is partially open the cover 132 partially controls air flow of primary combustion air.

Figure 8:
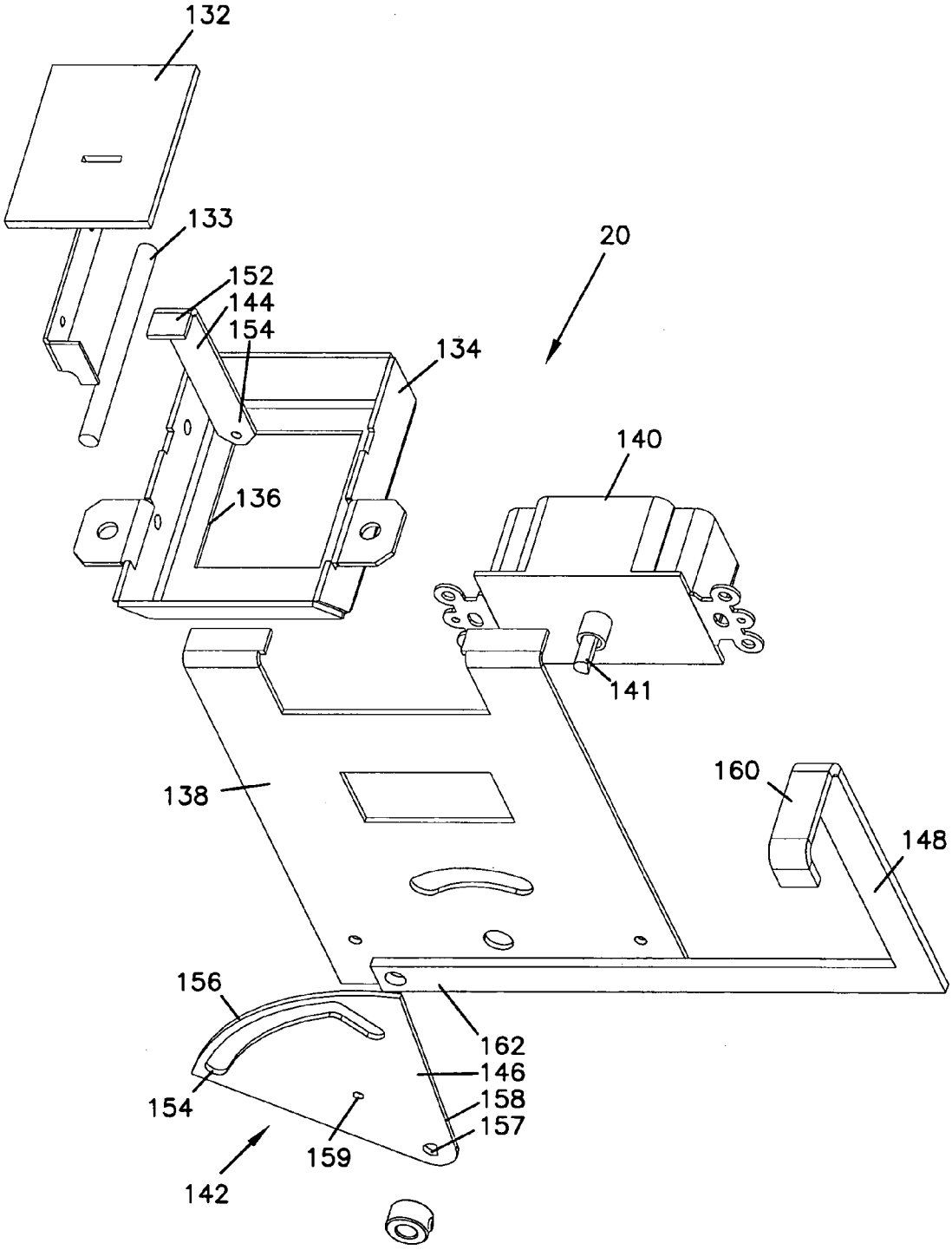
FIG. 8 is an exploded top perspective view of the automatic air intake control unit shown in FIG. 1.
Figure 11:
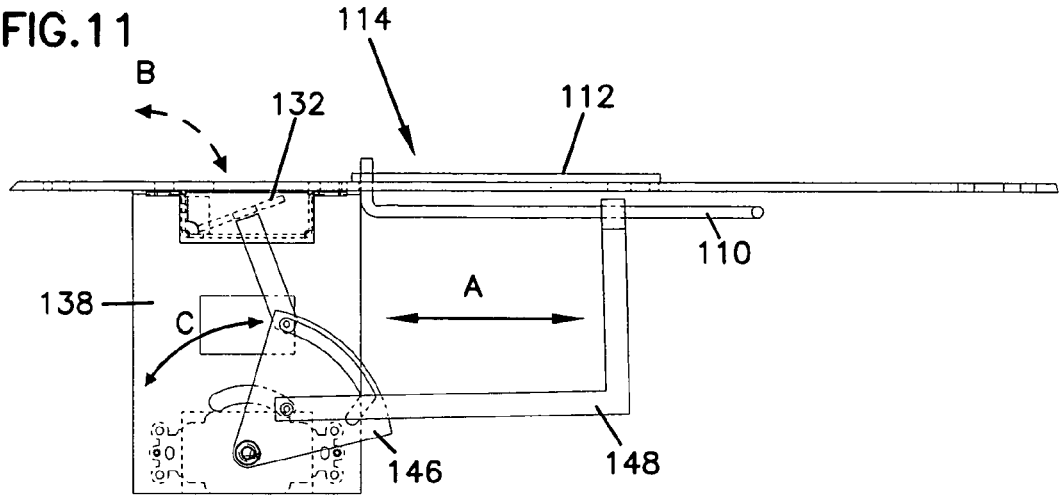
FIG. 11 is a close-up front view of the automatic air intake control unit shown in FIG. 1 with a front panel of the fireplace removed, the automatic air intake cover open, and the main air intake opening closed.

Automatic air intake control 20 also includes a pivot axle 133 for cover 132, a cover housing 134 that defines a housing air opening 136 (see FIG. 8), a mounting plate 138, a timer 140 having a timer shaft 141, and an actuating assembly 142. The actuating assembly 142 includes a first link 144 connected to cover 132, a second link 146 coupled between first link 144 and timer 140, and a third link 148 extending between second link 146 and control arm 110 of the main air control 18. First link 144 includes a first end 150 coupled to a slot 154 formed in second link 146, and a second end 152 coupled to cover 132. The slot 154 is formed in a first end 156 of second link 146, and a second end 158 of second link 146 is coupled to timer shaft 141 via a timer mounting hole 157. A first end 160 of third link 148 is coupled to control arm 110, and a second end 162 of third link 148 is coupled to second link 146 via a third link mounting hole 159. Thus, control arm 110 may be used to move cover 132 between a closed position shown in FIG. 5 and the open position shown in FIGS. 9 and 11 through this series of linkages. When in the closed position, cover 132 may provide a substantially air tight seal with automatic air intake opening 130.

Figure 9:
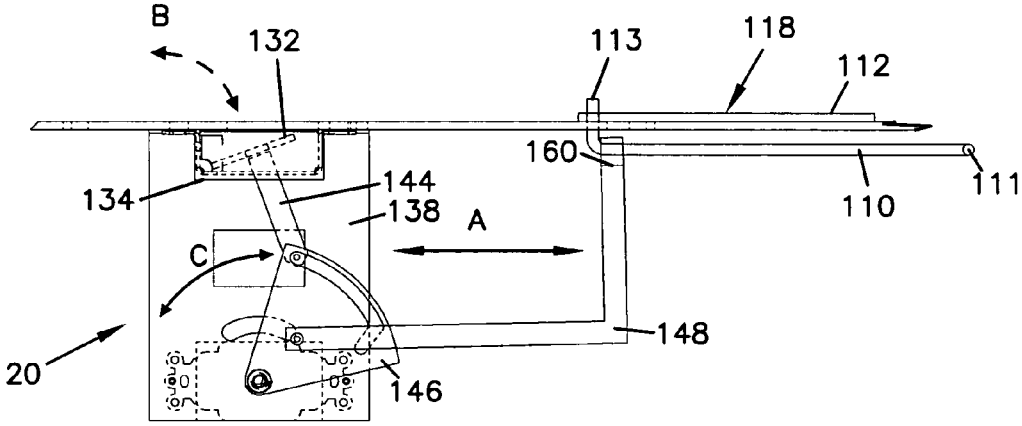
FIG. 9 is a close-up front view of the automatic air intake control unit shown in FIG. 1 with a front panel of the fireplace removed, the automatic air intake cover open, and the main air intake opening open.
Figure 10:
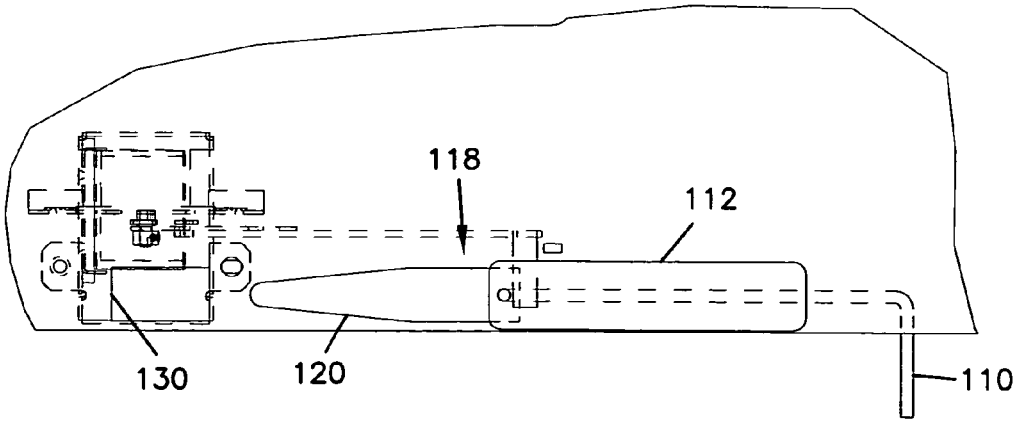
FIG. 10 is close-up top view of the automatic air intake control unit configuration shown in FIG. 9.
Figure 12:
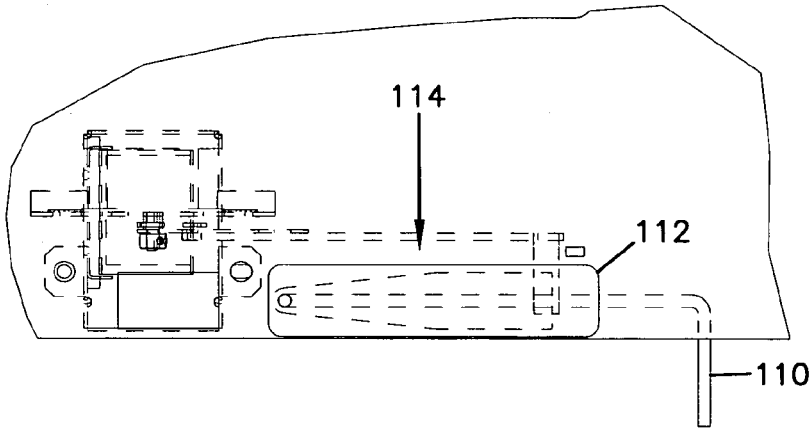
FIG. 12 is a close-up top view of the automatic air intake control unit configuration shown in FIG. 11.

When cover 132 is in the closed position, the control arm 110 is free to move cover 112 between a closed position shown in FIG. 12 and a partially open position (not shown) so that combustion air may flow freely through main air opening 120 without altering the position of cover 132. In order to move cover 132 into an open position (as shown in FIG. 9), control arm 110 must be moved all the way to the right in the direction A to contact the first end 160 of third link 148 (see FIGS. 9 and 10), which results in second link 146 rotating to the right in the direction C thereby moving the first end 152 of first link 144 in slot 154 that raises first link 144 vertically. Moving first link 144 vertically relative to the fixed vertical position of second link 146 moves cover 132 into an open position.

When timer 140 is coupled to second link 146, opening cover 132 via the actuating assembly 142 concurrently sets the timer 140. The opened position of cover 132 varies as timer 140 winds back to a rest position by rotating timer shaft 141 at a predetermined rate. For example, the slot configuration shown in at least FIGS. 5 and 9 maintains the cover 132 in an open position throughout a majority of the length of the slot (which corresponds to a predetermined amount of time controlled by timer 140), and then drops the cover 132 into a closed position corresponding to the end of slot 154 near the end of the predetermined period of time.

Figure 13:
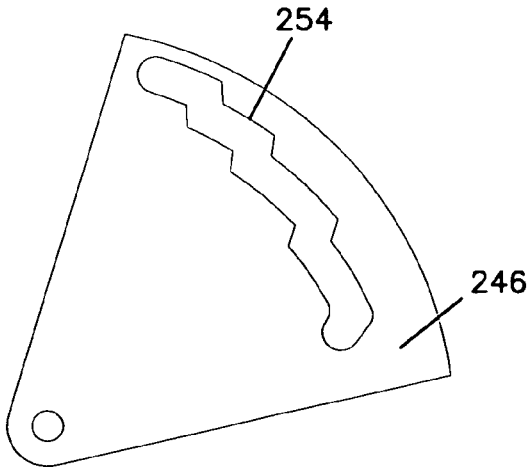
FIG. 13 is a front view of an example actuating member according to principles of the present invention that includes a step-wise slot.

Other configurations, such as the second link configuration 246 shown in FIG. 13, a step wise slot 254 may be used to lower the cover a predetermined distance at varied times during the predetermined cycle set by timer 140. This stepwise control of the air intake can be used to maximize the burn efficiency of a fire in the combustion chamber 54 based upon the state of burn of the solid fuel. For example, the solid fuel may need more air initially to begin to burn with both primary and secondary combustion. As the solid fuel continues to burn and converts from an organic to a charcoal state, less air may be needed for primary and secondary combustion. Alternatively, the cover 132 can be closed at any other rate based on any given slot pattern that provides sufficient air to burn the solid fuel. In some embodiments, the actuating assembly may include a cam surface in place of or in addition to a shaped slot to control a position of the cover relative to an air intake opening.

In yet further embodiments, the position of cover 132 may be controlled electronically or in a more direct way rather than using the linkages included in actuating assembly 142. For example, timer 140 may be coupled directly to the cover pivot axle 133 via the timer shaft 141, and the timer 140 may be set electronically, with a direct manual control arm, using remote technology, or other means whereby the setting of timer 140 is not controlled by manually moving control arm 110. Furthermore, timer 140 may be any type of mechanical or electrical control unit (such as, for example, an electrical drive mechanism, servo motor, air activation unit, or hydraulics) that is configured to control the size of an air passage opening between the fresh air channel 102 and the combustion chamber 54 in an automated way. As discussed above, the timer 140 may replaced or supplemented with any other type of device, mechanism, or system that uses alternative basis for control, such as, for example, temperature, emissions, light, pressure, static, or any other method that uses inputs associated with the combustion of fuel in the fuel-burning unit or a user's preferences for the characteristics of combustion in the fuel-burning unit.

The automatic air intake control 20 discussed above may be particularly useful in a fireplace that includes the manifold system 24 and air wash system 22. As shown in FIG. 16, a flow of fresh combustion air 180 that passes through either or both of the main air opening 120 and the automatic air intake opening 130 (see, for example, FIG. 10) is directed through a primary combustion air opening 60 into combustion chamber 54 as primary combustion air flow 182 for primary combustion of fuel in the combustion chamber lower portion 56. Fresh combustion air 180 may also be directed up the vertical air channels 70, 72 as air flow 184 into the manifold chambers 74, 76 and distributed through manifold distribution tubes 78, 80, 82 (see FIG. 15) for secondary combustion in the upper portion 58 of combustion chamber 54. Still further, fresh combustion air 180 may be directed into the vertical channels 90, 92 of air wash system 22 as air wash air flow 186 and directed by the slot formed in air wash plate 94 across a front surface of combustion chamber enclosure 14 (see FIGS. 14 and 16) and further directed into combustion chamber 54 to assist in primary or secondary combustion of the fuel. All of the air flows 182, 184, 186 are exhausted out of the combustion chamber 54 through the inner exhaust vent 31 as exhaust air flow 188 (see FIG. 16).

Fireplace 10 may have different configurations in which the fresh combustion air 180 is directed to different areas of the fireplace depending on whether the fresh combustion air 180 passes through main air opening 120 or automatic air intake opening 130. For example, automatic air intake control 20 may direct fresh combustion air 180 directly to only the lower portion 56 of combustion chamber 54, the manifold system 24, the air wash system 22, or a combination of these or other directed paths.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. An apparatus for burning solid fuel, the apparatus comprising:

a combustion chamber enclosure defining a combustion chamber for combustion of a fuel and including an air passage opening; and an automatic air intake control coupled to the fireplace to regulate air intake into the combustion chamber through the air passage opening for combustion of the fuel, the automatic air intake control comprising:

a cover movable between open and closed positions relative to the air passage opening;

an actuating assembly including an actuating member and a follower member, the actuating member including a follower surface formed therein, and the follower member including a first end coupled to the cover and a second end that engages the follower surface; and a timer coupled to the actuating member, the timer configured to actuate the actuator member to control the position of the cover to regulate air intake into the combustion chamber.

2. The apparatus of claim 1, wherein an engagement position of the follower member on the follower surface corresponds to positions of the cover between the open and closed positions.

3. The apparatus of claim 1, wherein the follower surface includes a first portion defining a first open position for the cover, a second portion defining a second open position, and a third portion defining a closed position, and the controlling step includes moving the follower member between the first, second and third portions of the follower surface.

4. The apparatus of claim 1, wherein the cover rotates about a shaft and the actuating member rotates about a shaft that is parallel with the cover shaft, and the timer controls rotation of the actuating member.

5. The apparatus of claim 1, wherein the timer includes a rotatable shaft coupled to the actuating member, and rotation of the shaft is controlled in a timed manner.

6. The apparatus of claim 1, wherein the apparatus is a wood-burning stove and the solid fuel is a fibrous product.

7. The apparatus of claim 1, wherein the automatic air intake control further includes a manual adjustment arm coupled to the timer and configured to manually set the timer for a predetermined air intake control period.

8. The apparatus of claim 7, wherein combustion chamber enclosure further includes a main air passage, and the manual adjustment arm includes a first member coupled to the actuating assembly and a second member controlling air intake through the main air passage.

9. The apparatus of claim 1, further comprising a secondary combustion system that includes a side riser and a manifold that direct combustion air to a top portion of the combustion chamber for secondary combustion of the solid fuel.

10. The apparatus of claim 9, further including a baffle positioned in the top portion of the combustion chamber, and the manifold directs combustion air adjacent to the baffle.

11. The apparatus of claim 10, wherein the baffle comprises a refractory material with high heat reflective properties.

12. The apparatus of claim 1, further comprising a front panel and an air wash system the air wash system including an air channel that directs air across a surface of the front panel within the combustion chamber.

13. The apparatus of claim 1, wherein the automatic air intake control is positioned at a bottom side of the combustion chamber enclosure.

14. The apparatus of claim 1, wherein the cover provides a substantially air-tight seal with the air passage.

15. A method for automatic control of air intake for combustion within an apparatus that burns solid fuel, the apparatus including a combustion chamber enclosure that defines a combustion chamber for combustion of fuel, an air passage opening formed in the combustion chamber enclosure, and an automatic air intake control that includes a cover, a timer, an actuating member having a follower surface, and a follower member, the method comprising the steps of:

coupling the actuating member to the timer;

coupling the follower member to the cover and engaging the follower member with the follower surface;

adjusting the cover between an open and closed position to control flow of combustion air through the air passage opening into the combustion chamber for combustion of the solid file; and controlling a position of the cover over a predetermined time period with the timer, wherein controlling includes moving the actuating member with the timer thereby moving the follower member along the follower surface to adjust the position of the cover.

16. The method of claim 15, wherein the follower surface includes a first portion defining a first open position for the cover, a second portion defining a second open position, and a third portion defining a closed position, and the controlling step includes moving the follower member between the first and second open positions and the closed position for the cover.

17. The method of claim 15, wherein the adjusting step includes setting the cover in the open position and the controlling step includes moving the cover from the opened position to the closed position.

18. An automatic air intake control for regulating air intake into an apparatus configured to burn solid fuel, the automatic air intake control comprising:

a cover movable between open and closed positions relative to the air passage opening;

an actuating assembly that includes an actuating member and a follower member, the actuator member having a follower surface, and the follower member being secured to the cover and engaging the actuating member along the follower surface;

a timer coupled to the actuating member and configured to actuate the actuating member to move the follower along the follower surface thereby controlling the position of the cover to regulate air intake into the apparatus.

19. The air intake control of claim 18, wherein the follower surface includes a plurality of steps, each step corresponding to a different position of the cover between the open and closed positions.

20. The air intake control of claim 18, wherein the timer includes a rotatable shaft that is coupled to the adjustable member, and rotation of the rotatable shaft moves the adjustable member thereby moving the follower member such that the cover is moved between the open and closed positions.

21. The air intake control of claim 18, further comprising a timer setting member coupled to the timer to set the timer for a predetermined air intake control period.

22. The air intake control of claim 18, wherein the follower surface is defined within a shaped slot that is formed in the actuator member.

23. An apparatus for burning solid fuel, the apparatus comprising:

a combustion chamber enclosure defining a combustion chamber for combustion of a fuel and including an air passage opening and a main air passage; and an automatic air intake control coupled to the fireplace to regulate air intake into the combustion chamber through the air passage opening for combustion of the fuel, the automatic air intake control comprising:

a cover movable between open and closed positions relative to the air passage opening; and a timer coupled to the cover and configured to control the position of the cover to regulate air intake into the combustion chamber;

wherein the automatic air intake control further includes a manual adjustment arm coupled to the timer and configured to manually set the timer for a predetermined air intake control period, and the manual adjustment arm includes a first member coupled to the actuating assembly and a second member controlling air intake through the main air passage.

24. The air intake control of claim 23, wherein the second member of the manual adjustment arm includes a sliding cover configured to slide relative to the main air opening to control air flow through the main air opening.

25. The air intake control of claim 24, wherein actuating the manual adjustment am to manually set the timer concurrently moves the sliding cover into a positioned closing the main air opening.

26. An apparatus for burning solid fuel, the apparatus comprising:

a combustion chamber enclosure defining a combustion chamber for combustion of a fuel and including an air passage opening;

a secondary combustion system that includes a side riser and a manifold that direct combustion air to a top portion of the combustion chamber for secondary combustion of the solid fuel; and an automatic air intake control coupled to the fireplace to regulate air intake into the combustion chamber through the air passage opening for combustion of the fuel, the automatic air intake control comprising:

a cover movable between open and closed positions relative to the air passage opening; and a timer coupled to the cover and configured to control the position of the cover to regulate air intake into the combustion chamber.

27. An apparatus for burning solid fuel, the apparatus comprising:

a combustion chamber enclosure defining a combustion chamber for combustion of the fuel and including an air passage opening;

a secondary combustion system that includes a side riser and a manifold that direct combustion air to a top portion of the combustion chamber for secondary combustion of the solid fuel;

a baffle positioned in the top portion of the combustion chamber, and the manifold directs combustion air adjacent to the baffle; and an automatic air intake control coupled to the fireplace to regulate air intake into the combustion chamber through the air passage opening for combustion of the fuel, the automatic air intake control comprising:

a cover movable between open and closed positions relative to the air passage opening; and a timer coupled to the cover and configured to control the position of the cover to regulate air intake into the combustion chamber.

28. The apparatus of claim 27, wherein the baffle comprises a refractory material with high heat reflective properties.

29. An apparatus for burning solid fuel, the apparatus comprising:

a combustion chamber enclosure defining a combustion chamber for combustion of a fuel and including an air passage opening;

a front panel and an air wash system, the air wash system including an air channel that directs air across a surface of the front panel within the combustion chamber, and an automatic air intake control coupled to the fireplace to regulate air intake into the combustion chamber through the air passage opening for combustion of the fuel, the automatic air intake control comprising:

a cover movable between open and closed positions relative to the air passage opening; and a timer coupled to the cover and configured to control the position of the cover to regulate air intake into the combustion chamber.

30. An automatic air intake control for regulating air intake into an apparatus configured to burn solid fuel, the automatic air intake control comprising:

a cover movable between open and closed positions;

a timer coupled to the cover and configured to control the position of the cover to regulate air intake into the apparatus;

an actuating assembly that includes an actuating member and a follower member, the actuator member being secured to the timer and having a follower surface, and the follower member being secured to the cover and engaging the actuating member along the follower surface;

wherein the follower surface includes a plurality of steps, each step corresponding to a different position of the cover between the open and closed positions.

* * * * *